US006435843B1

(12) United States Patent
Hur

(10) Patent No.: US 6,435,843 B1
(45) Date of Patent: Aug. 20, 2002

(54) RECIPROCATING PUMP FOR FEEDING VISCOUS LIQUID

(76) Inventor: Nam Jong Hur, B01, 611-109, Shinlim-Dong, Kwanak-Ku, Seoul (KR)

( * ) Notice: Subject to any disclaimer, the term of this patent is extended or adjusted under 35 U.S.C. 154(b) by 569 days.

(21) Appl. No.: 08/907,512

(22) Filed: Aug. 8, 1997

(30) Foreign Application Priority Data

Aug. 8, 1996 (KR) ..... 96/23928
Aug. 4, 1997 (KR) ..... 97/21451

(51) Int. Cl.[7] ..... F04B 17/00; F04B 35/00
(52) U.S. Cl. ..... 417/393; 417/398; 417/399; 417/401; 417/403; 417/404
(58) Field of Search ..... 417/393, 398, 417/404, 399, 403, 401

(56) References Cited

U.S. PATENT DOCUMENTS 764,156 A * 7/1904 Spencer ..... 91/313
3,056,353 A * 10/1962 Peters ..... 91/267
4,304,529 A * 12/1981 Gerich ..... 417/349
4,350,022 A * 9/1982 Kristapovich et al. ..... 62/174
4,444,547 A * 4/1984 Stolz ..... 417/46
4,515,516 A * 5/1985 Perrine et al. ..... 417/38
4,761,118 A * 8/1988 Zanarini ..... 417/254
5,433,240 A * 7/1995 Mueller ..... 137/99

* cited by examiner

*Primary Examiner*—Louis J. Casaregola
*Assistant Examiner*—Timothy P Solak

(57) ABSTRACT

Two cylindrical pump cylinders are mounted end-to-end. A first piston is placed in the first cylinder, a second piston is placed in the second cylinder, and the pistons are interconnected. In one embodiment compressed air alternately drives the first piston in either direction, causing the interconnected second piston to draw and pump high viscosity liquid in the second cylinder through the use of check valves. In another embodiment compressed air is alternately injected into one side of the first piston and one side of the second piston, thus alternately drawing and pumping liquid on the other side of the pistons. A heating jacket is placed around the cylinder pumping the liquid to heat and thus lower the viscosity of the liquid. Piston movement sensors that sense the limits of piston movement within the cylinders are mounted in the cylinder wall.

2 Claims, 7 Drawing Sheets

RECIPROCATING PUMP FOR FEEDING VISCOUS LIQUID

BACKGROUND

The present invention relates to a pump for feeding liquid substances, and more particularly to a pump having a structure suitable to feeding semi-liquid substances having high viscosity, in which feeding is achieved consecutively rather than intermittently.

In general, the conventional two-stroke type cylinder pump acts using inhalation and compression. This type of pump has the disadvantage in that the operations of inhalation and compression are conducted intermittently. A centrifugal pump feeds by using the centrifugal force of an impeller and has an advantage of continuous feeding. This pump is very sensitive to the viscosity of the substance being fed and thus has the disadvantage that substances having some viscosities cannot become the object of feeding.

In order to feed viscous substances, a pump having a structure similar to a vane pump is mainly used. This pump, being driven according to the viscosity, especially should be controlled by the substance being fed by means of continuous use. For this reason, it has the disadvantage of rising maintenance fees and frequent troubles. It also has the drawback of low volume ratio.

Further, a pump using a diaphragm was conceived in recent years. This pump settled some problems of the general pump. However, in pumps having such structure, the diaphragm consisting of soft rubber is restricted to the pressure limit enabling the feeding. For this reason, it has a problem in which the diaphragm is frequently torn when feeding a high viscosity substance.

To solve the conventional problems described above, the present invention was conceived. A pump according to the present invention has a structure which does not require any separate controller for controlling the driving of the pump, and by which continuous feeding can be performed without interruption, as the pump is automatically operated without regard to the viscosity of the substance being fed.

There is another invention related to the present invention, which was filed in Korea on Aug. 8, 1996 by the present applicant (Utility Model Application No. 23928).

SUMMARY

The present invention was conceived to solve the conventional problems described above. An object of the present invention is to provide a pump having a structure that enables consecutive feeding. Inhalation and discharge of the substance being fed are achieved by means of interlocking pump piston operation. The piston rod of the air cylinder is reciprocated with the power of compressed air, and the reciprocating stroke operation of the pump is automatically adjusted by the flexible match of compressed air in accordance with the viscosity of the substance being fed.

DETAILED DESCRIPTION OF THE PREFERRED EMBODIMENT

Hereinafter, desirable examples of the present invention will be described with reference to the accompanying drawings.

Figure 1:
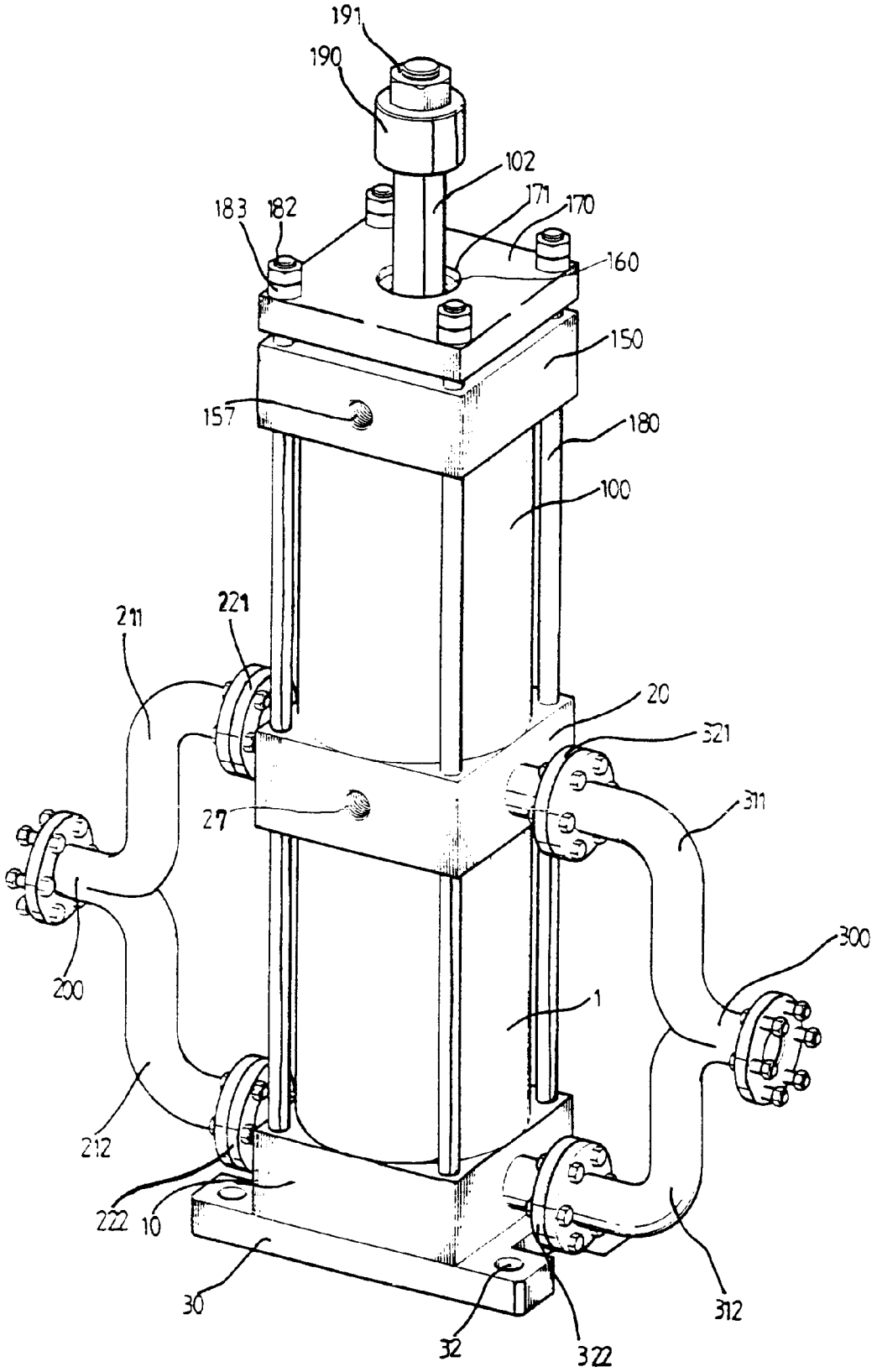
FIG. 1 is a perspective view illustrating a first example of the present invention.

FIG. 1 is a general perspective view illustrating a pump according to the present invention. A pump cylinder 1 is placed at the bottom, an air cylinder 100 driving the pump cylinder 1 is placed at the top, and the cylinders are interconnected. A lower block 10 and an intermediate block 20 are mounted opposing the top and bottom of pump cylinder 1. At the top of the air cylinder 100 an upper block 150 is mounted and assembled into a base 30.

Figure 2:
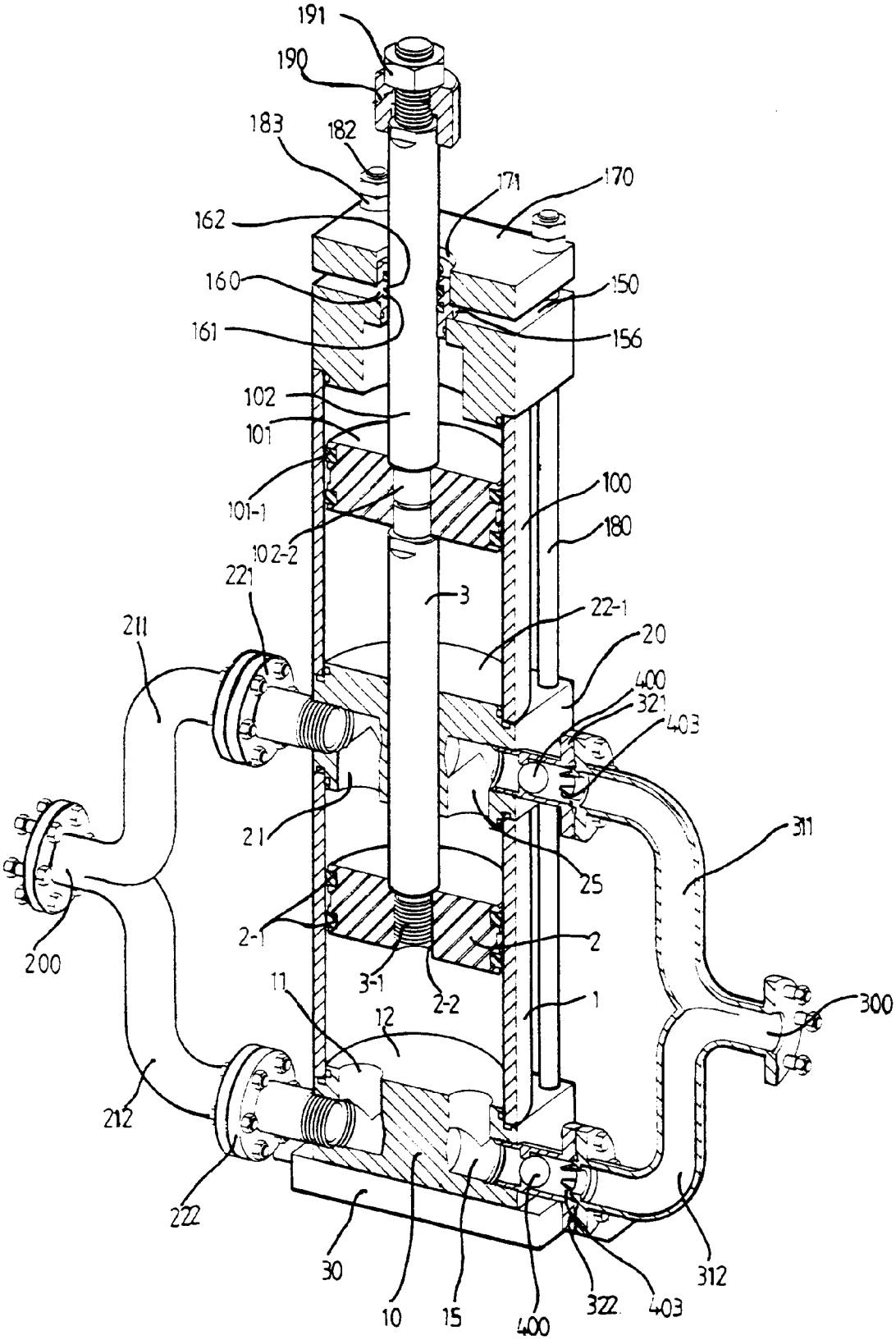
FIG. 2 is a sectional perspective view illustrating the first example of the present invention.

The pump having such construction is described with reference to FIG. 2 to FIG. 4. At the bottom of a base 30 four assembly screw holes are drilled. Outside of the screw holes a plurality of erection holes are drilled. The lower block is erected on the top. A lower suction hole 11 is formed on the left, drilled at right angles with a cylinder jaw 12 with a helix formed outside. Symmetrically to it, a lower discharge hole 15 is drilled at right angles with the cylinder jaw with a helix formed outside. On the peripheral curved surface of the cylinder jaw 12 a packing groove 14-1 is formed in which a packing 14 is put in, and at each edge an assembly hole 13 is drilled.

Cylindrical pump cylinder 1 is put into cylinder jaw 12. Piston ring 2-1 is inserted on the peripheral surface of pump piston 2. The piston is engaged with a rod bolt 3-1 that is formed at the bottom of a pump cylinder rod 3, also having a rod nut 3-2 at the top. The piston is assembled into the inside of pump cylinder 1.

A packing 24 is put into a pump cylinder jaw 22 that is formed at the bottom of the intermediate block 20. The assembled pump cylinder rod 3 passes through rod hole 26, formed in the middle of the intermediate block, and is assembled into the pump cylinder described above. On the left, an upper suction hole 21 is drilled at right angles on the pump cylinder jaw 22 and a helix is externally formed. Symmetrically to it, on the right an upper discharge hole 25 is drilled at right angles on the pump cylinder jaw 12 and a helix is externally formed. At the top of the intermediate block 20 an air cylinder jaw 22-1 is formed and packing 24-1 is inserted. Lower compressed air hole 27 is drilled at right angles in the front of intermediate block 20 and a helix is externally formed. Jaw 22-1 is assembled into cylindrical air cylinder 100.

Air piston 101 is placed on a part 102-2 that is integrally formed at the lower end of air cylinder rod 102. Limit helix part 102-3 at the top is such that rod bolt 102-1 is inserted through air piston 101. A rod nut 3-2 of the pump cylinder rod 3 is screwed with rod bolt 102-1, and air piston 101 is fixed between air cylinder rod 102 and pump cylinder rod 3 such that the air piston 101 is positioned in air cylinder 100.

Under the assembled state as described above, upper block 150, having air cylinder jaw 152 at the bottom, is assembled into the top of air cylinder 100. Air cylinder rod 102 passes through air cylinder rod hole 162 in rod bushing 160. Bushing packing 161 is in the middle of rod hole 162.

Rod bushing 160 is inserted into rod bushing hole 156 formed in the middle of the upper block. An upper compressed air hole 157 is drilled at right angles in the front surface of upper block 150, and a helix is externally formed. At each edge of upper block 150 an assembly hole 153 is drilled.

At the top of upper block 150 an assembly plate 170 is assembled. Rod bushing hole 171 is drilled in the middle of assembly plate 170, and rod bushing 160 is assembled into hole 171. An assembly hole 173 is drilled through at each edge of assembly plate 170. An assembly bolt 180, having an upper bolt 181 and a lower bolt 182, passes through assembly holes 13, 23, 153, and 173, drilled at the edge of upper block 150, intermediate block 20, and lower block 10, such that lower bolt 181 is screwed into assembly screw hole 31 of base 30. By fastening assembly nut 183 with assembly nut 182 on the other side of nut 183, the aforesaid parts are securely assembled. A limit 190 is inserted onto a limit helix part that is formed at the top of air cylinder rod 102, and limit nut 191 is placed thereon.

Upper suction check valve flanged tube 221 is attached on upper suction hole 21 of intermediate block 20. Lower suction check valve flanged tube 222 is attached on lower suction hole 11 of lower block 10. Upper suction flanged tube 211 and lower suction flanged tube 212 are integrally connected with flanged tube 221 and with confluent suction flanged tube 200.

Also, upper discharge check valve flanged tube 321 is attached on the upper discharge hole 25 of the intermediate block 20. Lower discharge check valve flanged tube 322 is attached on lower discharge hole 15 of lower block 10. Upper discharge flanged tube 311 and lower discharge flanged tube 312 are integrally connected with lower discharge check valve flanged tube 322 and with confluent discharge flanged tube 300.

Each of the aforesaid check valves has a common structure comprising a check valve ball 400, a valve mount 401, a valve spring 402, and a spring bench 403.

Hereinafter, the operation and effects of the present invention having the aforesaid construction will be described.

Figure 3:
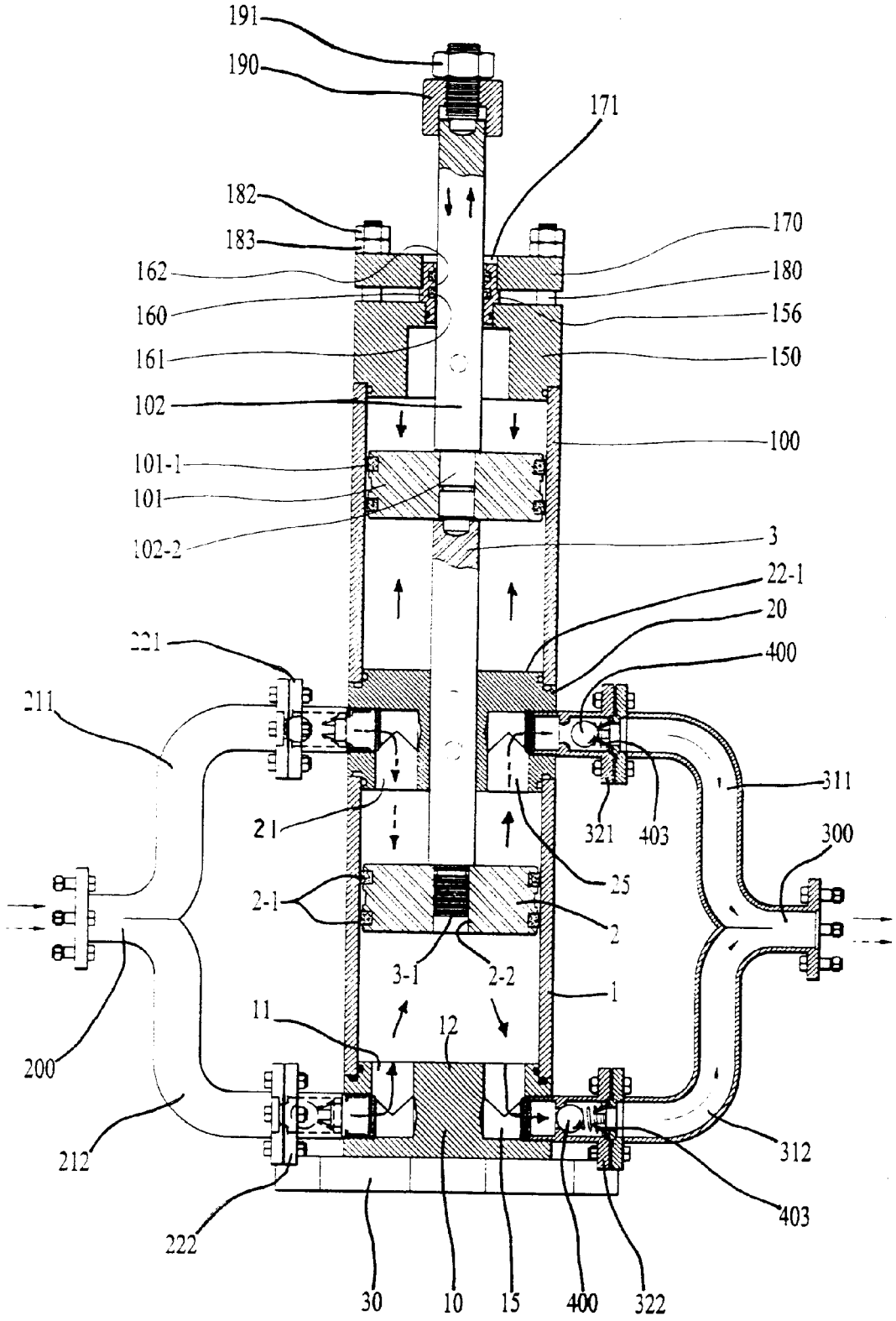
FIG. 3 is a front sectional view illustrating the first example of the present invention.
Figure 4:
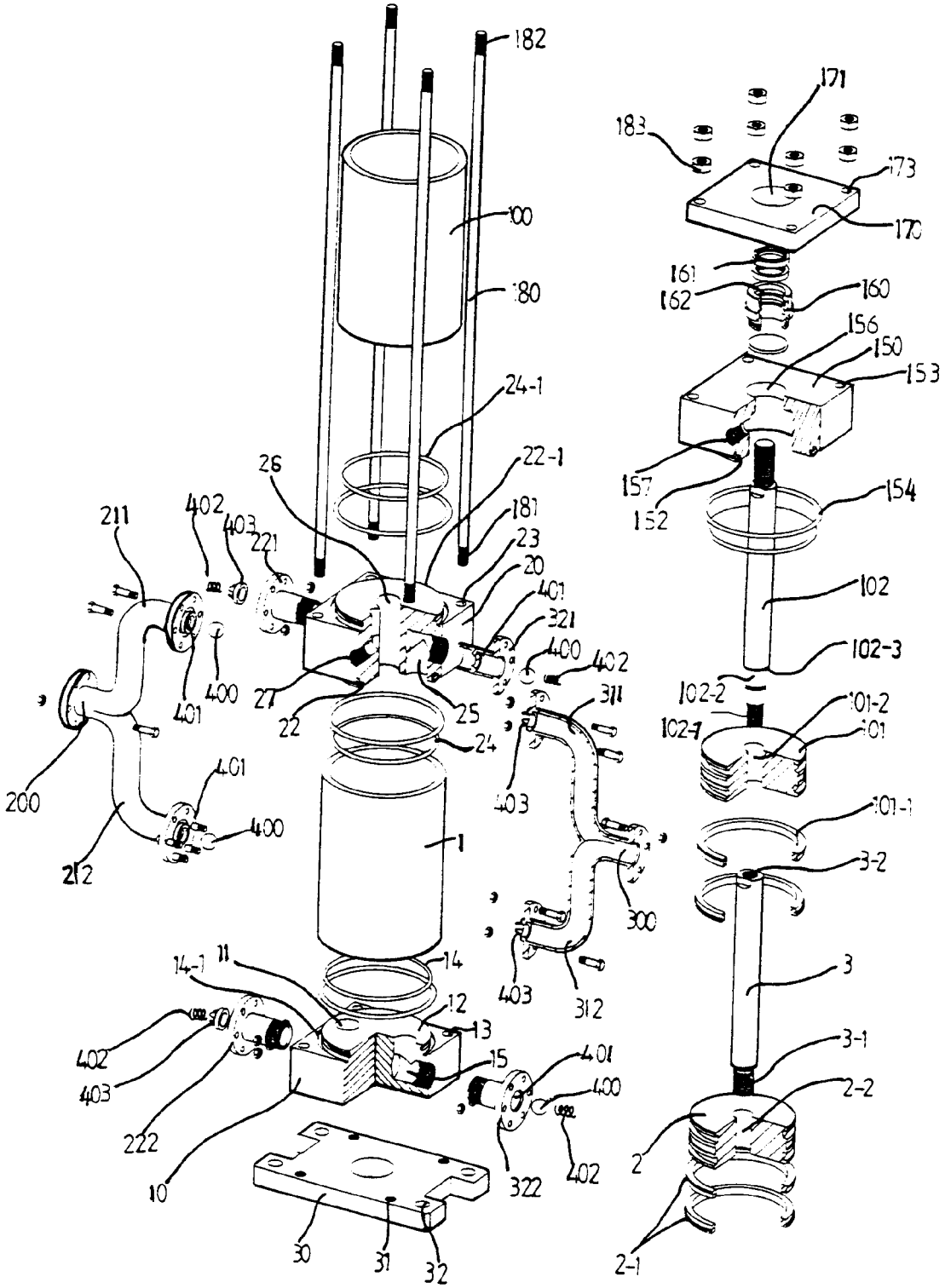
FIG. 4 is an exploded perspective view illustrating the first example of the present invention.
Figure 5:
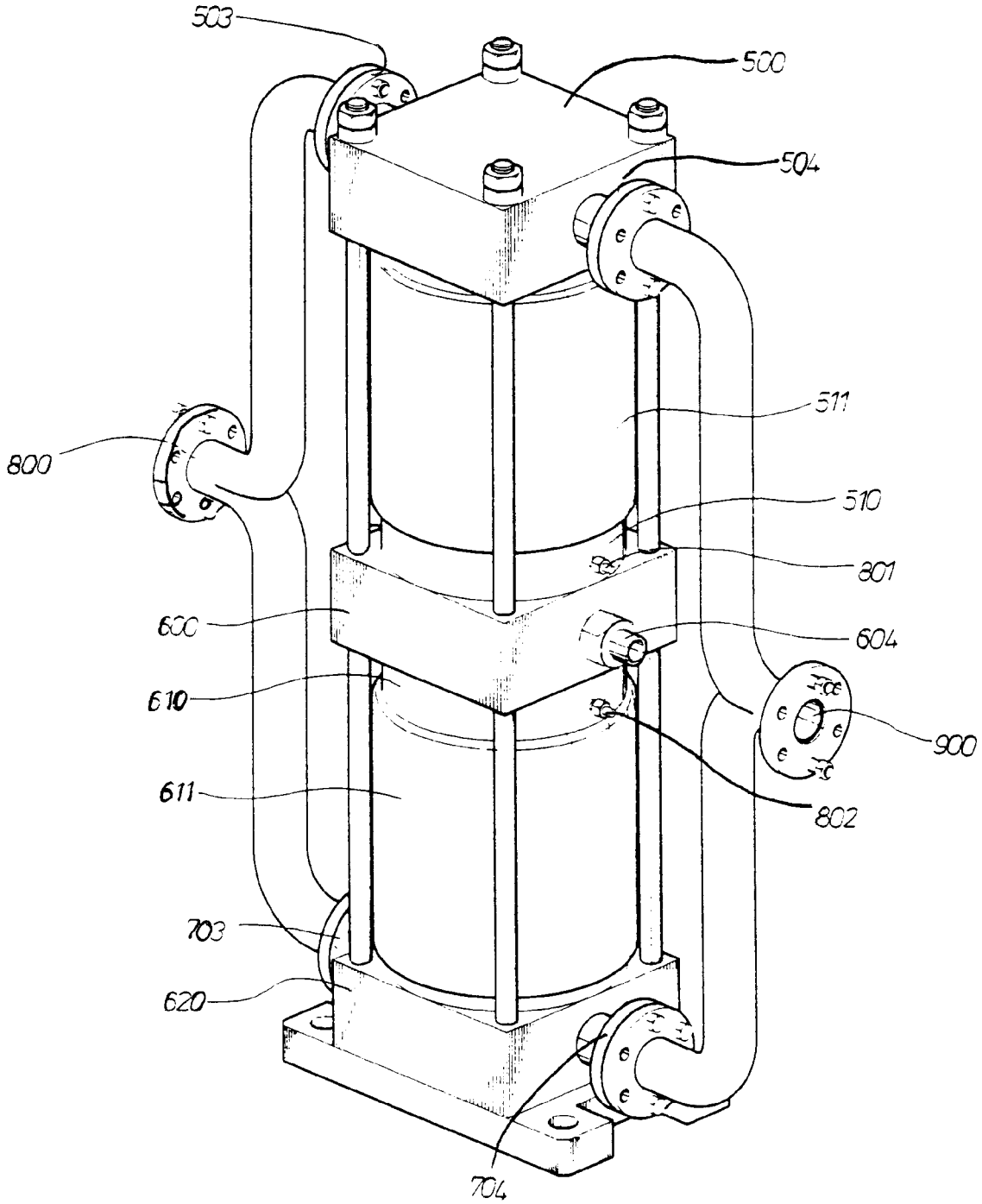
FIG. 5 is a perspective view illustrating a second example of the present invention.
Figure 6:
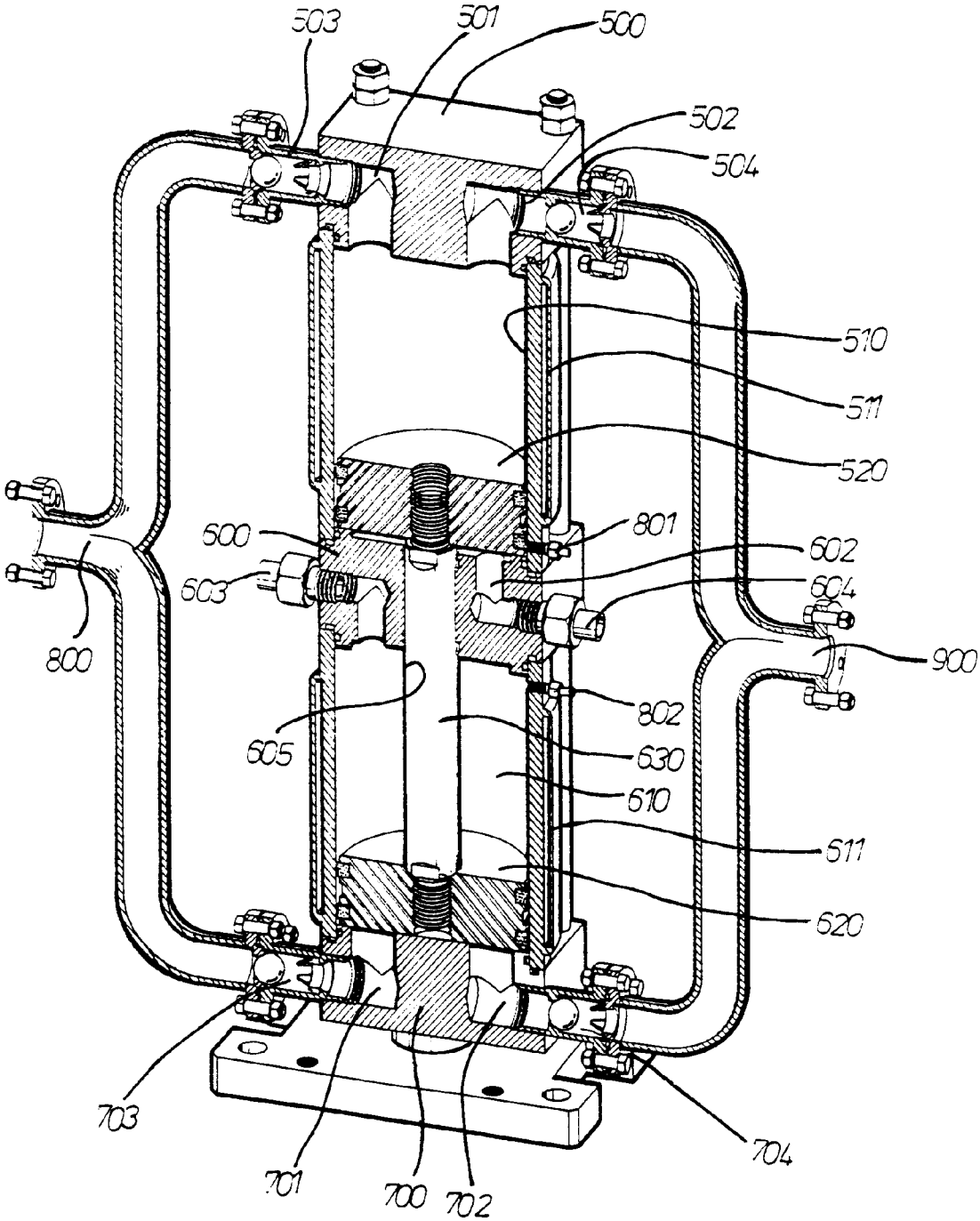
FIG. 6 is a sectional perspective view illustrating the second example of the present invention.

As shown in FIG. 3, the operation is advanced in a direction expressed in a solid line. Air cylinder 100 is filled with air by injecting compressed air through lower compressed air hole 27 of intermediate block 20. As air piston 101 moves upwardly, pump cylinder rod 3 is interlocked by being connected with air cylinder rod 102. If pump piston 2, connected with pump cylinder rod 3, is going up, upper suction check valve flanged tube 221, having a check valve, is closed and lower suction check valve flange 222 is opened.

The upper discharge check valve flanged tube 321 is opened, and lower discharge check valve flanged tube 322 is closed so that compressive feeding and suction can be achieved by the movement of the feeding substance at the same time.

Operation being advanced in an opposite direction is explained herebelow. As shown in a broken line of FIG. 3, when compressed air is injected through upper compressed air hole 157, formed in upper block 150, air piston 101 moves to the bottom. When air piston 101 is going down, pump piston 2, engaged with the end of pump cylinder rod 3 that is connected with the air piston is going down. In this case, upper suction check valve flanged tube 221 is opened and lower suction check valve flange 222 is closed.

The upper discharge check valve flanged tube 321 is closed and the lower discharge check valve flanged tube 322 is opened so that feeding substance sucked at the bottom is compressively fed and the bottom of the pump cylinder 1 is made vacuous. Consecutive compressive feeding from the confluent suction flanged tube 200 to the confluent discharge flanged tube 300 is enabled by means of consecutive pumping operation.

In the present invention having such operation, the quantity of compressed air is compressed according to the viscosity of the substance being fed and can be adjusted in proportion to the compression ratio of the compression generator. In the event that feeding of the substance being fed is smoothly performed without regard to the compression ratio, air piston 101 in air cylinder 100, being operated by injected air, reciprocates the full distance between a top dead center and a bottom dead center. A substance having relatively high viscosity, in relation to the air pressure having the compression ratio described above, is not smoothly fed and thus the air piston 101 of the air cylinder does not reach the top dead center and the bottom dead center. Despite this, air being injected is compressed more than the pressure of the air being injected, thereby, according to the viscosity of the feeding substance, not reciprocating the stroke distance of the pump piston 2 unreasonably so that the pumping apparatus can be protected.

Taking the feeding object of a chocolate or glucose as an example, the viscosity of a substance being fed varies according to the temperature of the environment using this apparatus or the temperature inside the apparatus according to the driving hours of this apparatus. The higher such temperature is, the lower the viscosity is. Consequently, feeding is performed more smoothly.

At the time of initial operation, the temperature of this apparatus is in a low state, and accordingly it is operated in the state of high viscosity. As a result, feeding is not smoothly performed.

Even when the feeding substance is of high viscosity, compressed air being injected into the air cylinder 100 reciprocates the air piston 101 of the air cylinder 100 flexibly, thereby not applying unreasonable pressure to pump cylinder 1.

Further, the construction and operation of other examples of the present invention may be seen. Upper suction tube 501 is mounted on the left of upper block 500 and is drilled to pass through to pump cylinder 510. On the right, upper discharge tube 502 passes through to upper cylinder pump 510. At the bottom of upper block 500 the upper pump cylinder 510 is mounted.

Inside of it an upper piston 520 is inserted and in the middle of upper piston 520 a piston rod 630 is connected. Rod 630 is engaged with lower piston 620 mounted inside lower pump cylinder 610 by passing through rod hole 605 in intermediate block 600. On the left of intermediate block 600 a lower compressed air supply tube 603 is mounted so that the compressed air can flow into the inside of intermediate block 600. And on the right an upper compressed air supply tube 604 is mounted so that the compressed air being supplied through the supply tube flows into upper pump cylinder 510.

On upper suction tube 501 an upper suction check valve flanged tube 503, being opened in a suction direction only, is mounted. On lower suction tube 701 of lower block 700 a lower suction check valve flanged tube 703 is mounted so that the upper suction check valve flanged tube 503 is connected with suction tube 800.

Further, on upper discharge tube 502 an upper discharge check valve flanged tube 504, being opened in a discharge direction only, is mounted. On lower discharge tube 702 of lower block 700 a lower discharge check valve flanged tube 704, being opened in a discharge direction only, is mounted so that the upper discharge check valve flanged tube 504 is connected with discharge tube 900.

Figure 7:
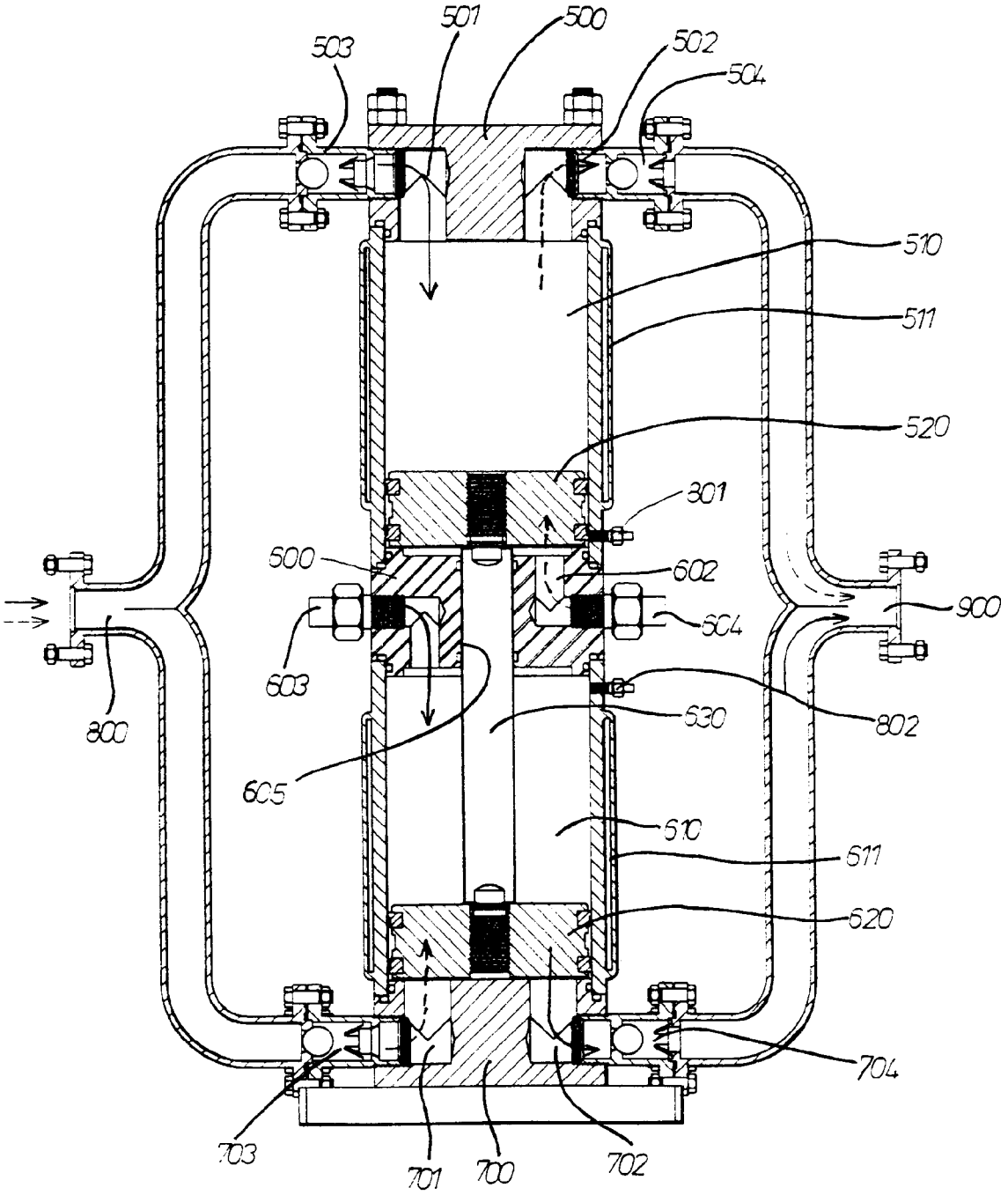
FIG. 7 is a front sectional view illustrating the second example of the present invention.

The operation of a second example of the present invention having such construction is explained herebelow. By injecting compressed air through lower compressed air supply tube 603, as expressed in a solid line shown in FIG. 7, the compressed air pushes lower piston 620 mounted inside lower cylinder pump 610. Thus lower piston 620 feeds the feeding substance in lower cylinder pump 610 to discharge tube 900 while lower piston 620 is going down. Upper piston 520, being interlocked with piston 620, sucks the feeding substance from upper suction tube 501. According to the pump's operation, lower suction check valve flanged tube 703 is closed and lower discharge check valve flanged tube 704 is opened, thereby compressively feeding the substance sucked inside the lower cylinder to discharge tube 900 while the lower piston 620 is going down and being compressed.

Further, the operation of the upper cylinder pump 510 is seen. Upper suction check valve flanged tube 503 is opened and upper discharge check valve flanged tube 502 is closed while lower piston 620 is going down in accordance with interlocking movement. Thus the feeding substance is sucked from suction tube 800 to upper suction pipe 501 by means of the vacuum of upper pump cylinder 510.

By injecting compressed air into upper compressed air supply tube 604, upper piston 520 goes up and upper suction check valve flanged tube 503 closes so that the feeding substance sucked in upper pump cylinder pump 510 is compressively fed to discharge tube 900 through upper discharge check valve flanged tube 504 that opens. And the interlocking lower piston 620 that is connected with upper piston 520 and piston rod 630 goes up and lower suction check valve flanged tube 703 opens by means of lower check valve flanged tube 702 being closed, thereby sucking the feeding substance.

A bottom dead center sensor 801 is mounted which senses the downward movement limit of upper piston 520. Also, a bottom dead center sensor 802 which senses the upward movement limit of lower piston 620 is mounted and connected with a controller which controls the supply of compressed air. Thus the reciprocating limit of the upper piston 520 and the lower piston 620 is sensed for smooth reciprocating operation.

Further, on the peripheral curved surface of upper pump cylinder 510 and lower pump cylinder 610, heating circular jackets 511, 611 are attached and heated for smooth feeding of substances having high viscosity. This heating prevents the feeding substance's viscosity from rising, especially during the winter season.

The present invention having such operation has a construction suitable for feeding substances having relatively high viscosity. It was conceived to solve the drawbacks which the conventional pump has in general. In the conventional pump, a tachometer driving the pump may cause overheating according to high load due to the feeding resistance resulting from feeding substances having viscosity. Especially in the case of a diaphragm pumping apparatus, the present invention solves the problem of the diaphragm being easily broken or damaged. Accordingly, the present invention has an advantage in which reciprocating movement distance of the piston being operated inside the pump according to the viscosity of the feeding substance is suitably adjusted in accordance with the feeding resistance.

In the meantime, it is obviously understood by the person skilled in the art that the present invention is not limited to the particular examples disclosed herein as the best mode contemplated for carrying out the present invention, and that various alterations or modifications thereof can be made within the present invention.

What is claimed is:

1. A pump comprising:

a first cylinder, a second cylinder, and an intermediate block sandwiched between respective ends of the first and second cylinders, wherein the first and second cylinders are axially aligned and are approximately the same size;

a top block positioned against an end of the first cylinder opposite the intermediate block, and a bottom block positioned against an end of the second cylinder opposite the intermediate block;

a first piston positioned in the first cylinder and a second piston positioned in the second cylinder, wherein the first and second pistons are connected by a rod slidably passing through a hole defined in the intermediate block, wherein the first piston is sealed against an interior surface of the first cylinder to form a first upper chamber between the first piston and the top block and a first bottom chamber between the first piston and the intermediate block, and wherein the second piston is sealed against an interior surface of the second cylinder to form a second upper chamber between the second piston and the intermediate block and a second lower chamber between the second piston and the lower block;

a first intake port, a first discharge port, a second intake port, and a second discharge port, wherein the first intake and discharge ports are defined in the top block between the first upper chamber and the exterior of the top block, and wherein the second intake and discharge ports are defined in the bottom block between the second lower chamber and the exterior of the bottom block;

a first gas port defined in the intermediate block between the second upper chamber and the exterior of the intermediate block, and a second gas port defined in the intermediate block between the first lower chamber and the exterior of the intermediate block, wherein compressed gas injected into the second upper chamber through the first gas port causes the second piston to move towards the bottom block and pump high viscosity liquid contained in the second lower chamber, and wherein compressed gas pumped into the first lower chamber through the second gas port causes the first piston to move towards the top block and pump high viscosity liquid contained in the first upper chamber;

a first confluent tube including a first portion coupled with the first intake port, a second portion coupled with the second intake port, and a third portion joining the first and second portions, and a second confluent tube including a fourth portion coupled with the first discharge port, a fifth portion coupled with the second discharge port, and a sixth portion joining the fourth and fifth portions;

a first intake check valve positioned adjacent the first intake port, a second intake check valve positioned adjacent the second intake port, a first discharge check valve positioned adjacent the first discharge port, and a second discharge check valve positioned adjacent the second discharge port, wherein the first and second intake check valves are configured to allow high viscosity liquid to flow only into their respective adjacent ports, and the first and second discharge check valves are configured to allow high viscosity liquid to flow only out of their respective adjacent ports;

a first sensor positioned in a wall of the first cylinder and a second sensor positioned in a wall of the second cylinder, wherein the first and second sensors are configured to sense a position of the first and second pistons, respectively, and are coupled to a controller that controls a supply of pressurized gas; and a first heating jacket placed around at least a portion of the first cylinder, and a second heating jacket placed around at least a portion of the second cylinder.

2. A pump comprising:

a first cylinder, a second cylinder, and an intermediate block sandwiched between respective ends of the first and second cylinders;

a top block positioned against an end of the first cylinder opposite the intermediate block, and a bottom block positioned against an end of the second cylinder opposite the intermediate block;

a first piston positioned in the first cylinder and a second piston positioned in the second cylinder, wherein the first and second pistons are connected by a rod slidably passing through a hole defined in the intermediate block, wherein the first piston is sealed against an interior surface of the first cylinder to form a first upper chamber between the first piston and the top block and a first bottom chamber between the first piston and the intermediate block, and wherein the second piston is sealed against an interior surface of the second cylinder to form a second upper chamber between the second piston and the intermediate block and a second lower chamber between the second piston and the lower block;

a first intake port, a first discharge port, a second intake port, and a second discharge port, wherein the first intake and discharge ports are defined in the intermediate block between the second upper chamber and the exterior of the intermediate block, and wherein the second intake and discharge ports are defined in the bottom block between the second lower chamber and the exterior of the bottom block;

a first gas port defined in the top block between the first upper chamber and the exterior of the top block, and a second gas port defined in the intermediate block between the first lower chamber and the exterior of the intermediate block, wherein compressed gas injected through the first gas port causes the second piston to move towards the bottom block and pump high viscosity fluid contained in the second lower chamber, and wherein compressed gas injected through the second gas port causes the second piston to move towards the intermediate block and pump high viscosity fluid contained in the second upper chamber;

a first confluent tube including a first portion coupled with the first intake port, a second portion coupled with the second intake port, and a third portion joining the first and second portions, and a second confluent tube including a fourth portion coupled with the first discharge port, a fifth portion coupled with the second discharge port, and a sixth portion joining the fourth and fifth portions;

a first intake check valve positioned adjacent the first intake port, a second intake check valve positioned adjacent the second intake port, a first discharge check valve positioned adjacent the first discharge port, and a second discharge check valve positioned adjacent the second discharge port, wherein the first and second intake check valves are configured to allow high viscosity liquid to flow into their respective adjacent ports, and the first and second discharge check valves are configured to allow high viscosity liquid to flow out of their respective adjacent ports; and a heating jacket placed around at least a portion of the second cylinder.

* * * * *